US006900584B2

(12) United States Patent
Ha et al.

(10) Patent No.: US 6,900,584 B2
(45) Date of Patent: May 31, 2005

(54) MASK-FRAME ASSEMBLY FOR COLOR CATHODE-RAY TUBE HAVING COMPENSATING UNIT

(75) Inventors: Kuen-dong Ha, Seongnam (KR); Arimoto Nozomu, Suwon (KR); Joon-soo Bae, Seoul (KR); Joon Lee, Busan (KR); Deok-hyeon Choe, Suwon (KR); Gui-bae Kim, Seongnam (KR); Dong-hwan Kim, Suwon (KR)

(73) Assignee: Samsung SDI Co., Ltd., Suwon-Si (KR)

( * ) Notice: Subject to any disclaimer, the term of this patent is extended or adjusted under 35 U.S.C. 154(b) by 79 days.

(21) Appl. No.: 09/938,838

(22) Filed: Aug. 27, 2001

(65) Prior Publication Data

US 2002/0135286 A1 Sep. 26, 2002

(30) Foreign Application Priority Data

Jan. 12, 2001 (KR) ..... 2001-1878

(51) Int. Cl.[7] ..... H01J 29/80

(52) U.S. Cl. ..... 313/407; 313/402; 313/405; 313/406

(58) Field of Search ..... 313/402, 405–407

(56) References Cited

U.S. PATENT DOCUMENTS 4,798,992 A * 1/1989 Ichigaya et al. ..... 313/406
5,751,098 A * 5/1998 Ito et al. ..... 313/402
6,225,736 B1 * 5/2001 Gorog ..... 313/407
6,246,164 B1 * 6/2001 Heyman et al. ..... 313/407
6,274,975 B1 * 8/2001 Reed et al. ..... 313/407
6,437,496 B1 * 8/2002 Kim et al. ..... 313/402
6,512,326 B1 * 1/2003 Arai et al. ..... 313/407
6,590,326 B2 * 7/2003 Diven et al. ..... 313/402

FOREIGN PATENT DOCUMENTS

JP 59-16626 1/1984
JP 2000-003682 1/2000
JP 2000003682 A * 1/2000 ..... H01J/29/07

OTHER PUBLICATIONS

Patent Abstract of Japanese application 59–018825, published Jan. 31, 1984.
Patent Abstract of Japanese application 2000–003682, published Jan. 7, 2000.
Patent Abstract of Japanese application 11–317176, published Nov. 16, 1999.

* cited by examiner

*Primary Examiner*—Vip Patel
*Assistant Examiner*—Anthony Perry
(74) *Attorney, Agent, or Firm*—Staas & Halsey LLP

(57) ABSTRACT

A mask-frame assembly for a color cathode-ray tube comprising a first and second support members spaced out a predetermined distance; first and second resilient support members installed between the first and second support members supporting the first and second support members, each at the first and second resilient support members comprising supports fixed to the first and second support members and a connecting portion connecting the supports; a mask installed at the first and second support members such that tension is applied thereto, the mask comprising a plurality of electron beam through holes; and a compensating unit connected between the first and second support members or the supports of the resilient support members between each connecting portion and the mask, the compensating unit being formed of a material having a lower thermal expansion coefficient than the first and second resilient support members.

40 Claims, 11 Drawing Sheets

MASK-FRAME ASSEMBLY FOR COLOR CATHODE-RAY TUBE HAVING COMPENSATING UNIT

CROSS REFERENCE TO RELATED APPLICATIONS

This application claims the benefit of Korean Application No. 2001-1878, filed Jan. 12, 2001, in the Korean Patent Office, the disclosure of which is incorporated herein by reference.

BACKGROUND OF THE INVENTION

1. Field of the Invention

The present invention relates to a color cathode-ray tube, and more particularly, to a mask-frame assembly having an improved frame for supporting a mask to apply tension in a color cathode-ray tube.

2. Description of the Related Art

In typical color cathode-ray tubes, three electron beams emitted from an electron gun pass through beam passage holes of a shadow mask for color selection and land on red, green and blue phosphors of a phosphor layer formed on the screen of a panel to excite the phosphors, thereby forming an image. In such color cathode-ray tubes, dot masks employed in computer monitors and slot (or slit) masks employed in televisions are representative masks for color selection. Such a mask is fixed to a frame and installed within a panel of a cathode-ray tube.

Representative slot masks are forming masks which are designed to have a curvature corresponding to the curvature of a screen taking into account landing of electron beams deflected with respect to the screen and tension masks which are supported such that tension is applied thereto taking into account a screen which is flattened to compensate for image distortion and expand a visual field angle.

Structures of a combination of a frame and a mask to which tension is applied are disclosed in Japanese Patent Publication Nos. sho 59(1984)-18825 and sho 59(1984)-16626. The disclosed tension mask-frame assembly includes a pair of support bars which are disposed in parallel to each other with a predetermined space therebetween, and substantially U-shaped resilient support members for supporting both ends of the support bars. An aperture grill-type mask is fixed to the support bars such that a tension can be applied to the mask.

In a course of manufacturing the above mask-frame assembly, a blackening process and an annealing process are performed to eliminate a stress attendant upon welding of the support bars and resilient support members and to blacken the mask and the frame composed of the support bars and the resilient support members. During the above processes, the mask-frame assembly is heated to about 500 C. Here, plastic deformation or thermal creep occurs in the mask due to the difference in the amount of thermal expansion between the frame and the mask and a decrease in a breaking strength limit depending on temperature, thereby causing a problem of a reduction in the tension (by 20%). In other words, when the mask-frame assembly is heated, a difference in the amount of thermal expansion between the mask and the frame occurs because the heat capacity of the mask is smaller than that of the frame. The difference in the amount of thermal expansion acts on the mask supported by the support bars as an additional tension, thereby decreasing the tension of the mask after the blackening and annealing processes. The decrease in the tension of the mask causes howling or drift of electron beams when a color cathode-ray tube employing the mask-frame assembly is place in operation.

To overcome the above problem, U.S. Pat. No. 5,111,107 discloses a mask-frame assembly for preventing the expansion of a frame from acting in the tension direction of a mask. The disclosed mask-frame assembly is shown in FIG. 1. The mask-frame assembly includes mutually opposed support bars 11, resilient support members 12 attached between the support bars to support the support bars, a mask 13 supported by the support bars 11, and metallic members 14 which have a larger thermal expansion coefficient than the resilient support members 12 and are connected to the lower surfaces of the resilient support members 12 opposite to the surfaces thereof facing the mask 14. Even though the mask-frame assembly 10 is provided with metallic members 14, the tension of the mask 13 is decreased, and the effect of the metallic members 14 varies with a tension distribution.

Meanwhile, Japanese Patent Publication No. hei 11-317176 discloses a color cathode-ray tube having a mask-frame assembly for reducing a decrease in the tension of a mask during the blackening and annealing processes. In the disclosed color cathode-ray tube, a color selection electrode is installed at a frame which includes a pair of mutually opposed supports and a pair of resilient support members disposed between the supports. Adjustment members having a smaller thermal expansion coefficient in a low temperature range and a greater thermal expansion coefficient in a high temperature range than the resilient support members are fixed to the sides opposite to the sides of the resilient support members facing the grid, or adjustment members having the reverse characteristic of the above are fixed to the sides of the resilient support members . A color selection device of a color cathode-ray tube having such a structure, in which adjustment members are attached to resilient support members to use a difference in thermal expansion coefficient as described above, cannot radically overcome the above problems.

A different color selection device and color cathode-ray tube are disclosed in Japanese Patent Publication No. 2000-3682. The disclosed color selection device includes a color selection electrode assembly with a mask suspended on a frame. A tension adjustment member parallel to the mask of the color selection electrode assembly is installed at a color selection electrode frame. Such a color selection device including a tension adjustment member installed at a frame to compensate for a decrease in a tension after a blackening or annealing process cannot prevent a decrease in the tension of a mask during the blackening or annealing process.

SUMMARY OF THE INVENTION

To solve the above-described problems, it is an object of the present invention to provide a mask-frame assembly for a color cathode-ray tube which can prevent a decrease in the tension of a mask due to the plastic deformation of the mask caused by a difference in the amount of thermal expansion between the mask and a frame during a blackening or annealing process, and which can reduce the drift of electron beams due to expansion of the mask and howling due to vibration of the mask.

Additional objects and advantages of the invention will be set forth in part in the description which follows, and, in part, will be obvious form the description, or may be learned by practice of the invention.

Accordingly, to achieve the above and other objects of the present invention, there is provided a mask-frame assembly for a color cathode-ray tube, wherein the mask-frame assembly includes first and second support members spaced out a predetermined distance; first and second resilient support members installed between the first and second support members for supporting the first and second support members, each resilient support member including supports fixed to the first and second supports and a connecting portion connecting the supports; a mask installed at the first and second support members such that tension is applied thereto, the mask including a plurality of electron beam passage holes; and a compensating unit connected between the first and second support members or supports between each connecting portion and the mask, the compensating unit being formed of a material having a lower thermal expansion coefficient than that of the first and second resilient support members.

To achieve the above and other objects of the present invention there is also provided a mask-frame assembly for a color cathode-ray tube, wherein the mask-frame assembly includes a frame including first and second support members spaced out a predetermined distance, and first and second resilient support members installed between the first and second support members supporting the first and second support members, each of the first and second resilient support members compromising supports fixed to the first and second supports and a connecting portion connecting the supports; a mask installed at the first and second support members such that tension is applied thereto, the mask comprising a plurality of electron beam passage holes; and a compensating unit connected between the first and second support members or the supports of the first and second resilient members between each connecting portion and the mask, the compensating unit being formed of a material having a lower thermal expansion coefficient than the first and second resilient support members. The values of the length L of the frame, the sectional area A of the compensating unit, a difference in thermal expansion between each resilient support member and the compensating unit, a height H from the center of the height of each resilient support member to the compensating unit, and a second order section modulus I in an X direction when the horizontal and vertical directions of the section of each resilient support member are represented by X and Z, respectively, are set to satisfy $0.1 \leqq (A \times H^2 \times \Delta\alpha \times 10^4)/I$.

To achieve the above and other objects of the present invention, there is still also provided a mask-frame assembly for a color cathode-ray tube, including a frame including first and second support members spaced out a predetermined distance, and first and second resilient support members installed between the first and second support members, supporting the first and second support members, each of the first and second resilient support members including supports fixed to the first and second supports and a connecting portion connecting the supports; a mask installed at the support members such that tension is applied thereto, the mask including a plurality of electron beam passage holes; and a compensating unit connected between the first and second support members or supports of the first and second resilient members between each connecting portion and the mask so that the tension of the mask is to be transferred to the compensating unit during annealing of the frame and the mask and then the tension is re-transferred from the compensating unit to the mask after cooling, thereby maintaining an initial tension of the mask.

BRIEF DESCRIPTION OF THE DRAWINGS

The above and other objects and advantages of the present invention will become more apparent by describing in detail preferred embodiments thereof with reference to the attached drawings in which.

DETAILED DESCRIPTION OF THE INVENTION

Figure 1:
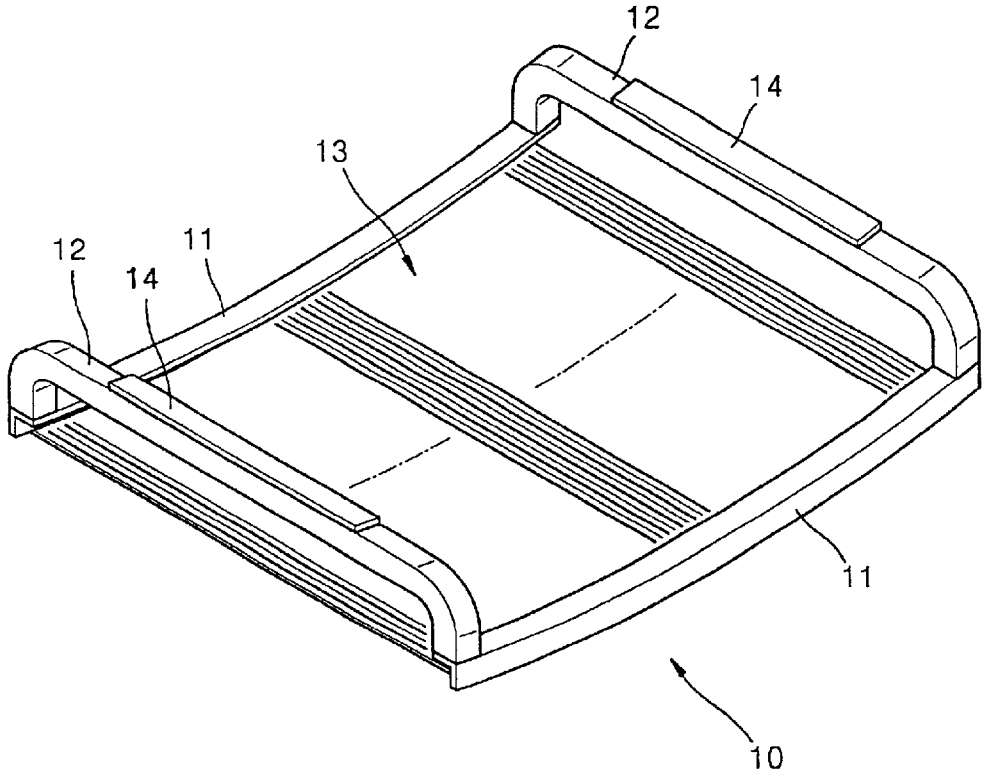
FIG. 1 PRIOR ART
FIG. 1 is a perspective view of a conventional mask-frame assembly.

Reference will now be made in detail to the present embodiments of the present invention, examples of which are illustrated in the accompanying drawings, wherein like reference numerals refer to like elements throughout.

Figure 2:
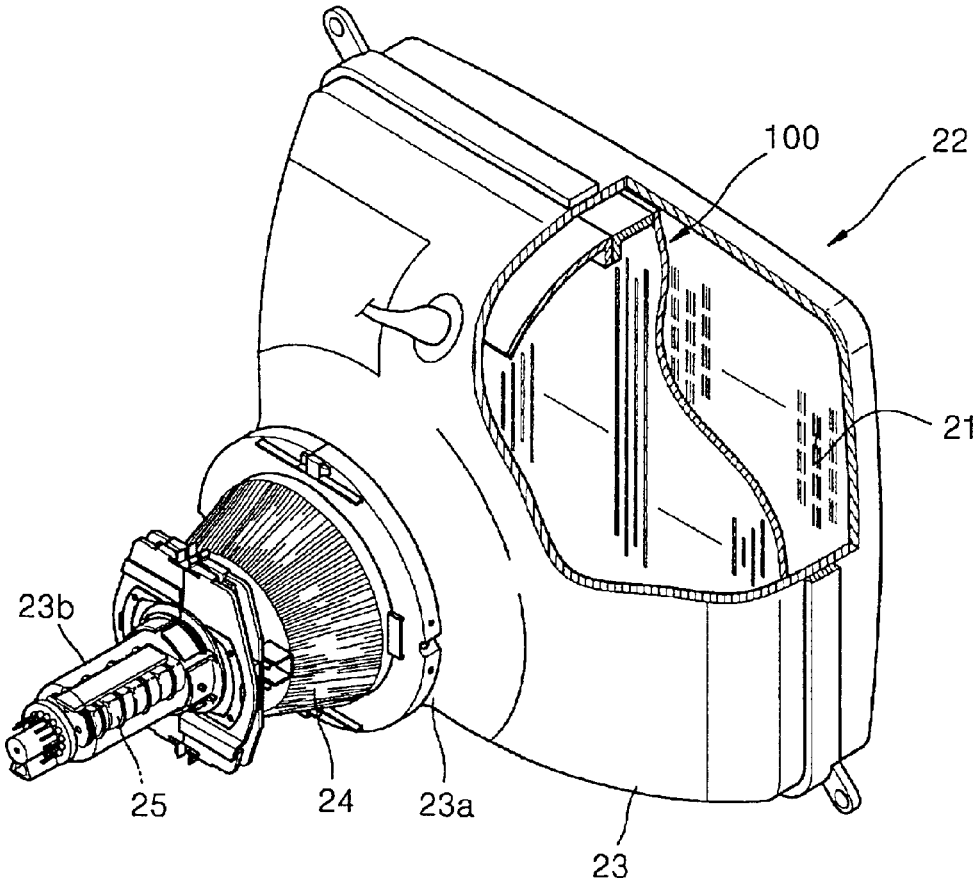
FIG. 2 is a partially cut away perspective view of a cathode-ray tube according to the present invention.

FIG. 2 shows an embodiment of a color cathode-ray tube according to the present invention. As shown in FIG. 2, the cathode-ray tube includes a panel 22 having a plane screen 21 with a phosphor layer, a funnel 23 which is sealed to the panel 22 and has a cone portion 23*a* and a neck portion 23*b*, a deflection yoke 24 provided between the cone portion 23*a* and the neck portion 23*b*, and an electron gun 25 provided in the neck portion 23*b*. On the inside of the panel 22 is installed a mask-frame assembly 100 having a function of selecting a color of an electron beam emitted from the electron gun 25.

Figure 3:
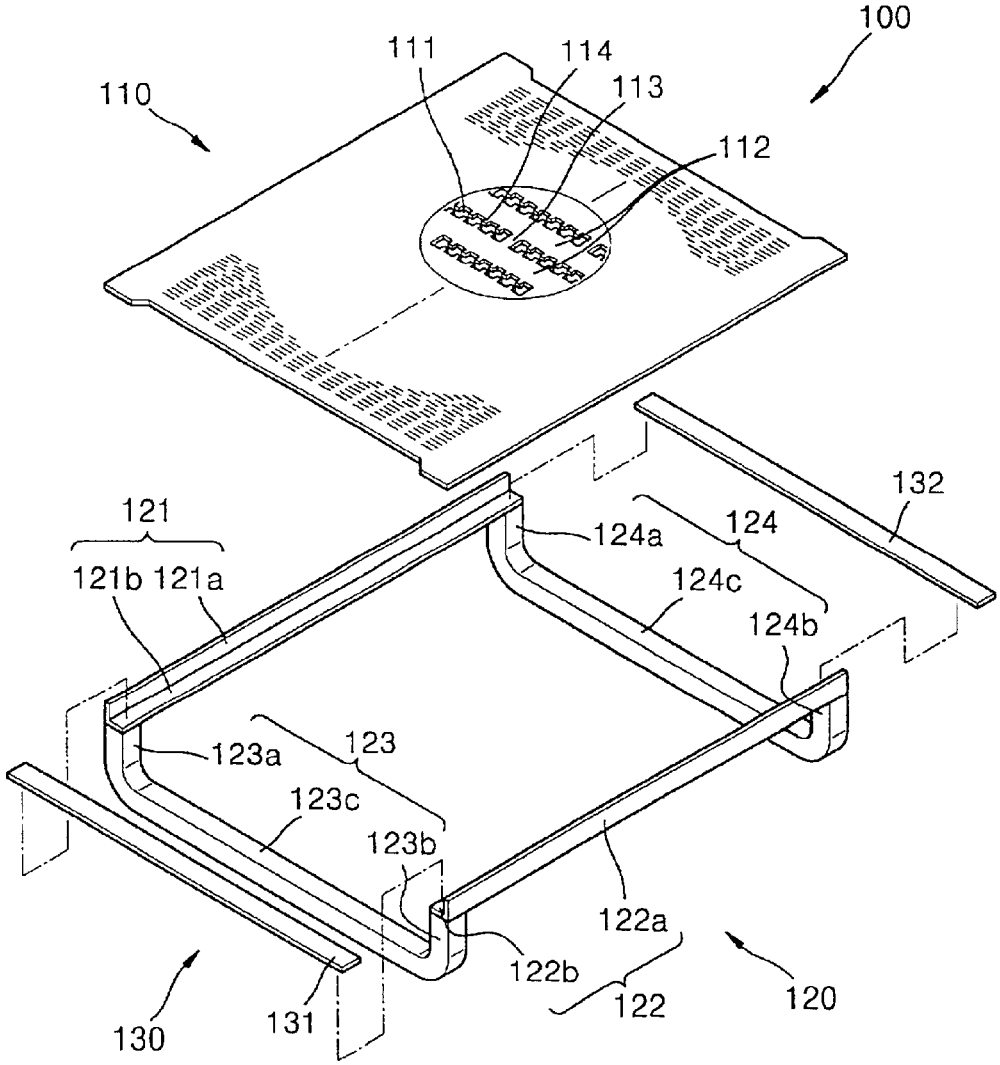
FIG. 3 is an exploded perspective view of an embodiment of a mask-frame assembly according to the present invention.

As shown in FIG. 3, the mask-frame assembly 100 includes a mask 110 and a frame 120 supporting the mask 110 such that the mask 110 has predetermined tension. The mask 110 includes a plurality of strips 112 spaced out a predetermined distance on a thin plate, and electron beam through holes 111 formed by a plurality of real bridges arranged between the respective strips 112 at predetermined pitches. Dummy bridges 114 expanding in opposite directions are formed between adjacent strips 112 to partition the electron beam through holes 111. A mask according to the present invention is not restricted to the above embodiment, but any one having a tension mask structure to which tension is applied can be used.

The frame 120 supports two opposite edges of the mask 110. The frame 120 includes a pair of first and second support members 121 and 122 spaced out a predetermined distance and first and second resilient support members 123 and 124 for supporting the first and second support members 121 and 122 such that tension is applied to the mask 110 supported by the first and second support members 121 and 122.

The first and second support members 121 and 122 include first and second keepers 121*a* and 122*a*, respectively, supporting the mask 110 and first and second flanges 121*b* and 122*b*, respectively extended from the first and second keepers 121*a* and 122*a* inward. The first and second resilient support members 123 and 124 supporting the first and second support members 121 and 122 include supports 123*a*, 123*b*, 124*a* and 124*b* fixed to the first and second support members 121 and 122, and connecting portions 123*c* and 124*c* for connecting the support 123*a* to the support 123*b* and connecting the support 124*a* to 124*b*, respectively. The configuration of the first and second support members 121 and 122 and the first and second resilient support members 123 and 124 is not restricted to the above embodiment, but any configuration capable of applying tension to the mask 10 can be used.

Figure 4:
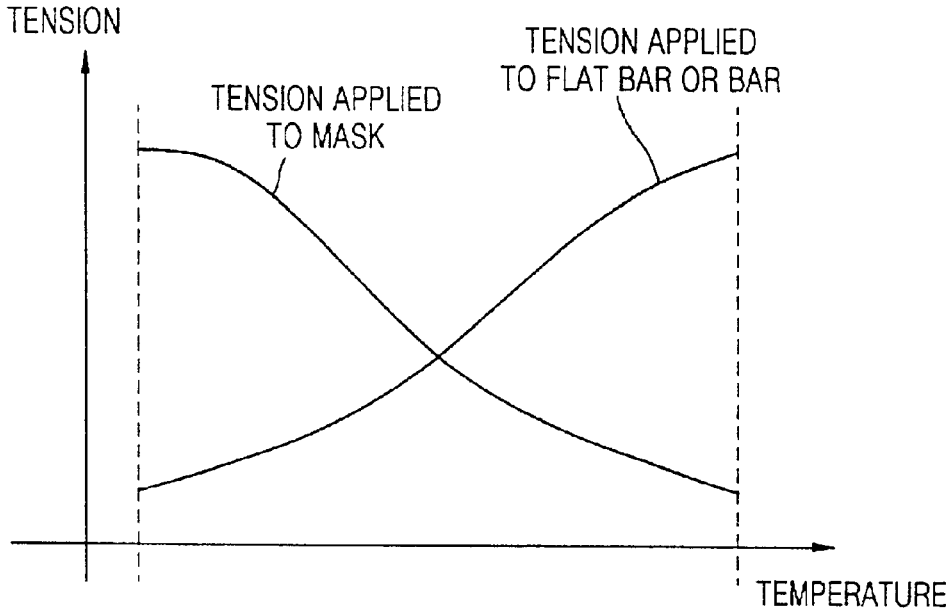
FIG. 4 is a graph of tension applied to flat bars or bars fixed to a frame versus tension applied to a mask.

A compensating unit 130 is provided between the tops of the connecting portions 123*c* and 124*c* of the first and second resilient support members 123 and 124 and the bottom of the mask 110 in order to prevent the mask 110 and frame 120 from being blackened and prevent tension from decreasing due to plastic deformation of the mask 110 caused by a difference in thermal expansion between the mask 110 and the first and second resilient support members 123 and 124 during an annealing process. In other words, the compensating unit 130 is provided at the first and second support members 121 and 122 or the supports 123*a*, 123*b*, 124*a* and 124*b* between the mask 110 and the connecting portions 123*c* and 124*c* so that a thermal expansion force attendant upon thermal expansion of the first and second resilient support members 123 and 124 is suppressed during annealing of the frame 120 and mask 110, as shown in FIG. 4. Consequently, the thermal expansion force of the first and second resilient support members 123 and 124 is restricted so as not to be applied to the mask 110. During cooling of the frame 120 and mask 110, the restriction of the first and second resilient support members 123 and 124 is terminated so that the elasticity of the first and second resilient support members 123 and 124 is applied to the mask 110. More specifically, the compensating unit 130 is installed at the first and second support members 121 and 122 or the supports 123*a*, 123*b*, 124*a* and 124*b* between the connecting portions 123*c* and 124*c* and the mask 110 so that the tension of the mask 110 is transferred to the compensating unit 130 during annealing of the frame 120 and mask 110 and the tension is re-transferred from the compensating unit 130 to the mask 110 after cooling, thereby maintaining the initial tension of the mask 110.

Figure 5:
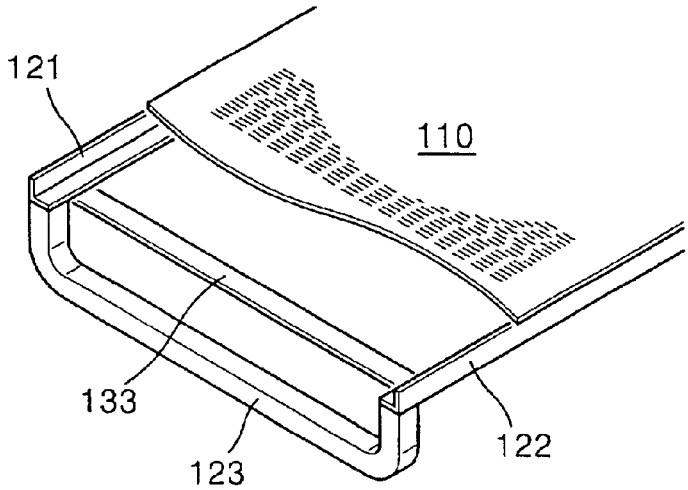
FIG. 5 is a perspective view of another embodiment of a mask-frame assembly according to the present invention.

An embodiment of such a compensating unit is shown in FIGS. 3 and 5. Referring to FIGS. 3 and 5, the compensating unit 130 includes a first flat bar 131 and a second flat bar 132 of which both ends are connected to the tops or bottoms of the flanges 121*b* and 122*b*, respectively, of the first and second support members 121 and 122. Here, the thermal expansion coefficient of each of the first and second flat bar 131 and 132 is smaller than that of each of the first and second resilient support members 123 and 124, and the thermal expansion coefficient of each of the first and second resilient support members 123 and 124 is not greater than that of the mask 110.

Figure 6:
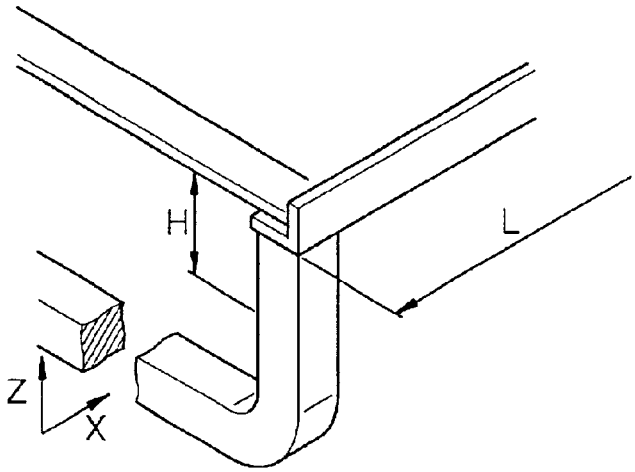
FIG. 6 is a partial perspective view showing the position relation between a frame and a flat bar.

Taking into account the thermal expansion coefficients and heat transmission process, the size of the first and second flat bars 131 and 132 of the compensating unit 130, which compensates for a reduction in tension on the mask 110 using a difference in the amount of thermal expansion with each of the first and second resilient support members 123 and 124, can be determined according to the expanded length of the first and second resilient support members 123 and 124. As shown in FIG. 6, in the case where the length of the frame 120 (i.e., the length of either of the first and second support members 121 and 122) is represented by L, the sectional area of either of the flat bars 131 and 132 of the compensating unit 130 is represented by A, a difference in thermal expansion between either of the first and second resilient support members 123 and 124 and either of the first and second flat bars 131 and 132 is represented by $\Delta\alpha$, a height from the center of the height of either of the first and second resilient support members 123 and 124 to either of the first and second flat bars 131 and 132 is represented by H, the horizontal and vertical directions of the section of either of the first and second resilient support members 123 and 124 are represented by X and Z, respectively, and a second order section modulus in the X direction is represented by I, according to experiments, when $0.1 \leqq (A \times H^2 \times \Delta\alpha \times 10^4)/I$ was satisfied in order to prevent the plastic deformation of the mask 110 due to a difference in thermal expansion between the mask 110 and the frame 120, a reduction in tension on the mask 110 was small. Particularly, when $0.1 \leqq (A \times H^2 \times \Delta\alpha \times 10^4)/I < 1$ was satisfied, a reduction in tension on the mask 110 was minimized.

Figure 7:
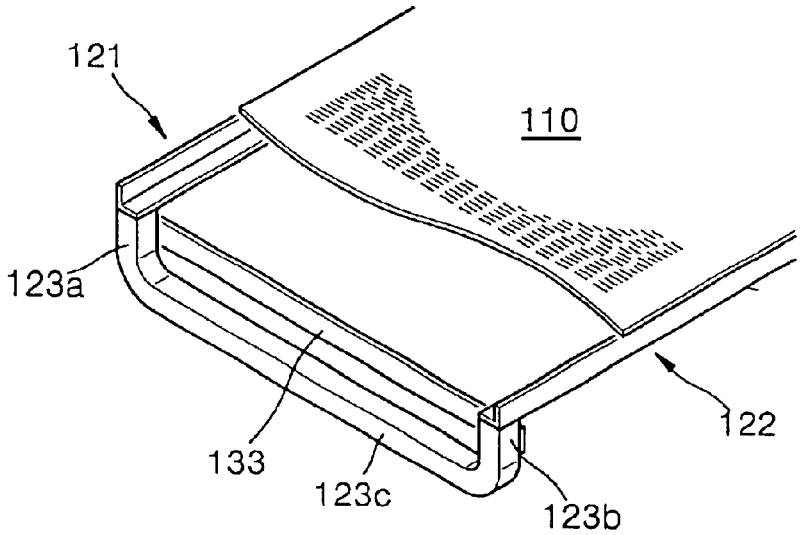
FIGS. 7 through 11 are perspective views of other embodiments of a mask-frame assembly according to the present invention.
Figure 8:
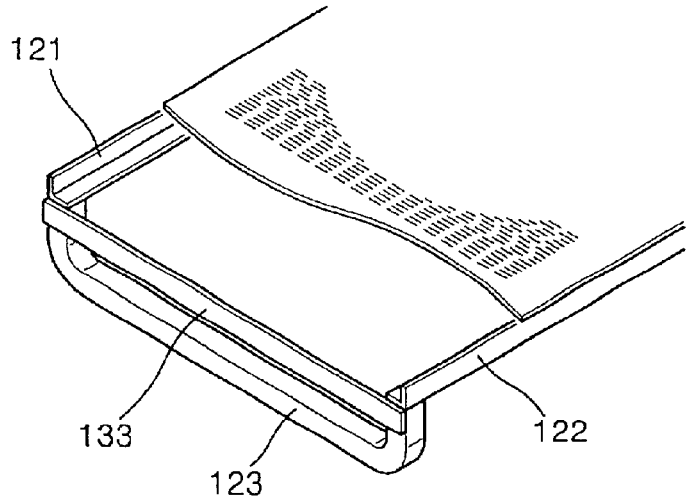

FIGS. 7 through 10 show other embodiments of a mask-frame assembly according to the present invention. As shown in FIGS. 7 and 8, for the compensating unit 130, a flat bar or bar 133 having a predetermined section is installed at the insides or outsides of the supports 123*a* and 123*b* of the first resilient support member 123. Further, bar 133 having the predetermined section, is installed in a similar fashion at the insides or outsides of the supports 124*a* and 124*b* of the second resilient support member 124 (although not shown).

Figure 9:
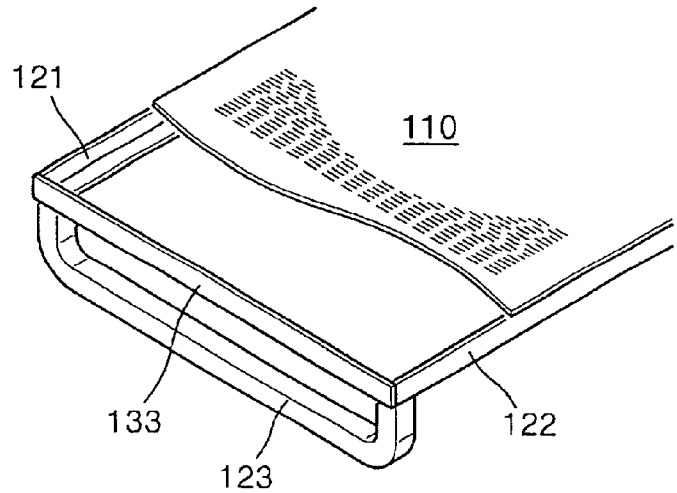

As shown in FIG. 9, a bar 133 for the compensating unit 130 is installed at the ends of first and second support members 121 and 122. Here, the bar 133 is welded to the ends of the first and second support members 121 and 122. Since the welded portions of the first and second support members 121 and 122 and the bar 133 may be deformed due to welding heat, it is preferable to use argon welding to minimize the welding heat.

Figure 10:
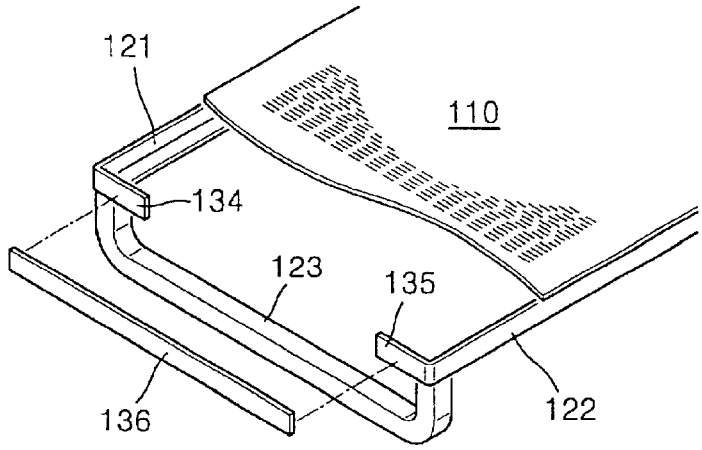

When a bar 136 for the compensating unit 130 is attached to the ends of first and second support members 121 and 122, as shown in FIG. 10, brackets 134 and 135 extended from the respective ends of the first and second support members 121 and 122 are provided, and the end portions of the bar 136 are fixed to the brackets 134 and 135, respectively. The end portions of the bar 136 may be attached to the brackets 134 and 135 by a separate coupling unit. For the coupling unit, bolts and nuts or rivets can be used. Alternatively, the brackets 134 and 135 can be directly coupled to the bar 136 by means of screws. Here, it is preferable to form screws at both ends of the bar 136 to spiral in opposite directions so that the bar 136 is fastened to or loosened from the brackets 134 and 135 by rotating the bar 136.

Figure 11:
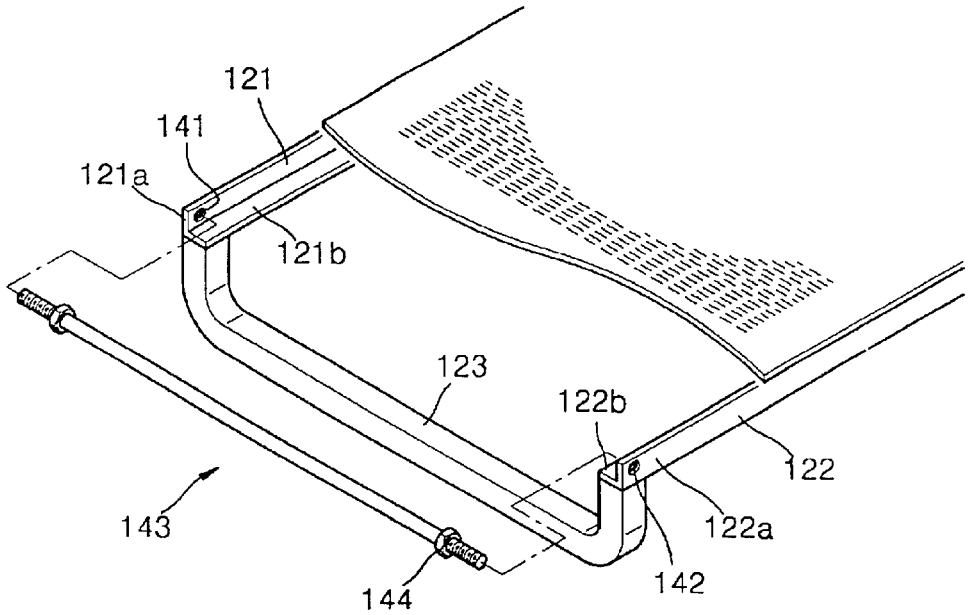

Another embodiment of a compensating unit is shown in FIG. 11. As shown in FIG. 11, female screws 141 and 142 are formed in the ends of the respective first and second keepers 121*a* and 122*a* of the first and second support members 121 and 122, and both ends of a support bar 143 are screwed into the female screws 141 and 142. The support bar 143 includes a position setting member 144 to settle the position of the support bar 143.

In the above embodiments, the relations among the thermal expansion coefficients of a resilient support member, mask and either of the bars 133 and 136 and support bar 143 for a compensating unit are the same as in the embodiment described before. Thus, a description thereof will be omitted. Further, although only one end of mask 110 is shown in the drawings, it is understood that similar configurations exist on the other end of the mask 110.

Figure 12:
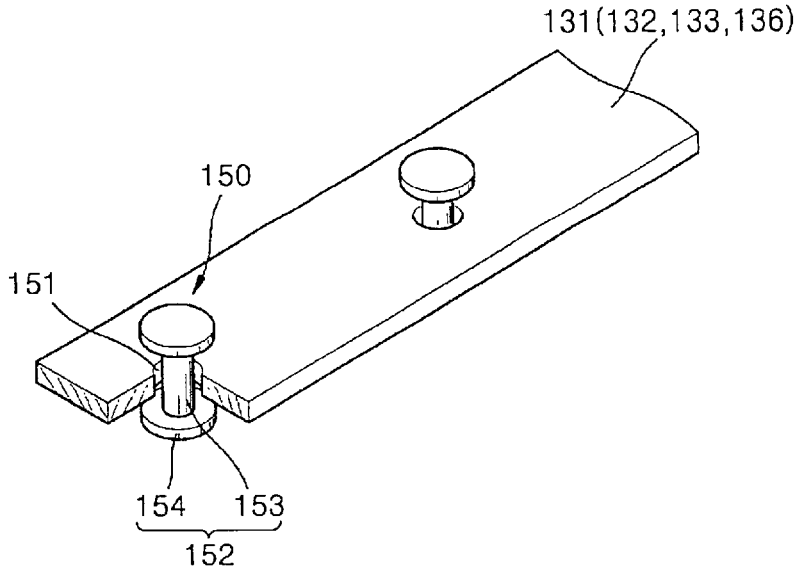
FIG. 12 is a partial perspective view showing a state in which a vibration preventing member is installed at a flat bar or a bar of a frame.

In the above embodiments, each of the first and second flat bars 131 and 132 and the bars 133 and 136 is provided with a vibration reduction unit 150 for reducing vibration caused by an external impact. As shown in FIG. 12, for the vibration reduction unit 150, at least one via-hole 151 is formed at each of the first and second flat bars 131 and 132 and the bars 133 and 136, and a vibration preventing member 152 is shakably inserted into the via-hole 151. This means that the vibration preventing member 152 is inserted into the via-hole 151 and be moved therein, and not fixed in the via-hole 151. The vibration preventing member 152 includes a body 153 which has a smaller diameter than the via-hole 151 and is inserted into the via-hole 151 such that it can shake with respect to the first and second flat bars 131 and 132 and the bars 133 and 136, and a head 154 formed at each end of the body 153 to prevent the body 153 from coming out of the via-hole 151. If an external impact is applied to the mask frame assembly 100, the vibration preventing member 152 eliminates vibration of the mask 110 by interference due to the movement of the vibration preventing member 152. The vibration preventing member 152 is not restricted to the above embodiment, but anything having a structure capable of preventing each of the first and second flat bars 131 and 132 and the bars 133 and 136 from vibrating can be used.

It should be noted that the compensating unit is not limited to the various embodiments disclosed herein, and may have other shapes besides a flat bar or a rod-shape. For example, L-shape, pipe-shape, parallelepiped-shape, and triangular-shape bars, etc., are possible.

The following description relates to the working of such a mask-frame assembly according to the present invention. In the mask-frame assembly 100, an external force is applied in facing directions to the first and second support members 121 and 122 supported by the first and second resilient support members 123 and 124 when the mask 110 is welded to the first and second support members 121 and 122 of the frame 120. The first and second resilient support members 123 and 124 are then elastically deformed to narrow the space between the first and second support members 121 and 122. In this state, two opposite edges of the mask 110 are welded to the first and second keepers 121*a* and 122*a*, respectively, of the first and second support members 121 and 122. Thereafter, when the external force to the first and second support members 121 and 122 is eliminated, tension is applied to the mask 110 due to the elasticity of the first and second resilient support members 123 and 124. After completing the installation of the mask 110, the first and second flat bars 131 and 132, bars 133, or bars 136, which constitute the compensating unit 130 and are formed of a material having a smaller thermal expansion coefficient than the first and second resilient support members 123 and 124, are installed between the tops of the respective connecting portions 123*c* and 124*c* of the first and second resilient support members 123 and 124 and the bottom of the mask 110 in such a manner as described in the above embodiments.

After completing the installation of the mask 110 and the compensating unit 130, the mask-frame assembly 100 is subjected to heat treatment performed at about 500 C in order to blacken the mask 110 and the frame 120 and eliminate a stress. During heat treatment, when the mask-frame assembly 100 is heated, the mask 110, the frame 120, and the first and second flat bars 131 and 132 or the bars 133 or 136 of the compensating unit 130 are thermally expanded. Since the thermal expansion coefficient of the first and second flat bars 131 and 132 forming the compensating unit 130 is smaller than that of the first and second resilient support members 123 and 124, the amount of thermal expansion of the first and second flat bars 131 and 132 of the compensating unit 130 is smaller than that of the first and second resilient support members 123 and 124, so that the first and second support members 121 and 122 are restrained from becoming more distant from each other due to the thermal expansion force of the first and second resilient support members 123 and 124. Accordingly, the thermal expansion of the first and second resilient support members 123 and 124 is prevented from working on the mask 110 as additional tension. Therefore, it does not happen that the tension of the mask 110 is reduced or the mask 110 is crept due to the plastic deformation of the mask 110 occurring when excessive tension is applied to the mask 110 during the heat treatment.

The workings described above will be more clarified by the following experiment.

Figure 13:
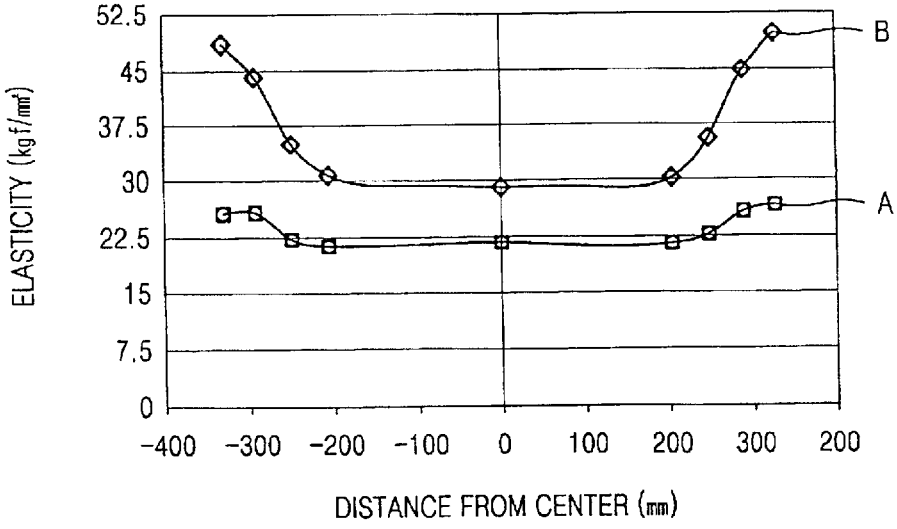
FIGS. 13 and 14 are graphs of mask tension of a conventional mask-frame assembly versus that of a mask-frame assembly according to the present invention, after heat treatment.

In this experiment, tension applied on the mask of a mask-frame assembly which was subjected to heat treatment without being provided with bars or flat bars forming a compensating unit at a frame was compared with tension applied on the mask of a mask-frame assembly which was provided with a compensating unit at a frame and then subjected to heat treatment, thereby obtaining the graph of FIG. 13. In the case of the mask-frame assembly in which the compensating unit was not attached to the frame, curve A of FIG. 13 shows that the tension is markedly reduced near the edge of the mask. In the case of the mask-frame assembly in which bars or flat bars forming a compensating unit was attached to the frame, B of FIG. 13 shows that the tension is not markedly reduced near the edge of the mask.

Figure 14:
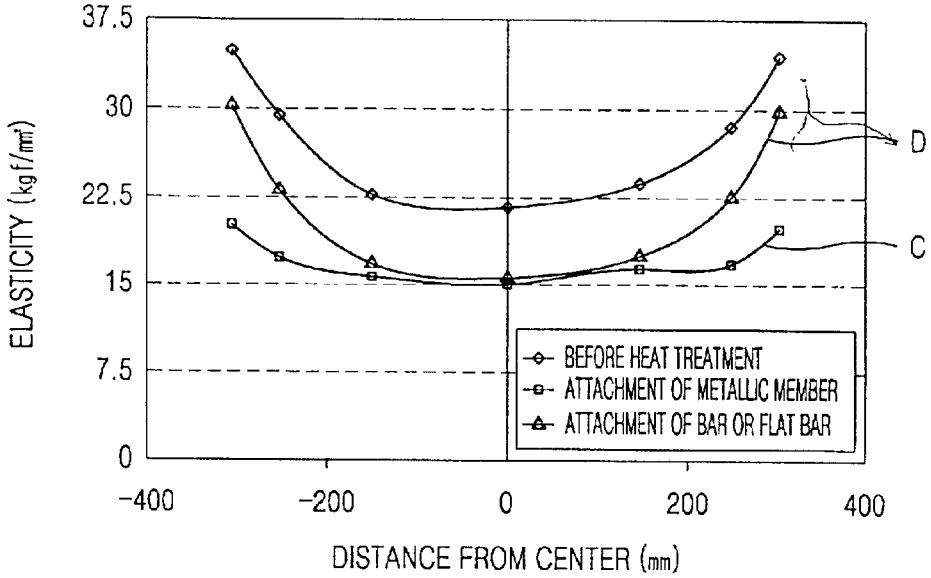

In this experiment, tension applied on the mask of a conventional mask-frame assembly which had metallic members on the bottoms of resilient support members and was subjected to heat treatment, tension applied on the mask of a mask-frame assembly which was provided with bars or flat bars forming a compensating unit according to the present invention and subjected to heat treatment, and tension applied on the mask of a mask-frame assembly before heat treatment are compared, thereby obtaining a graph shown in FIG. 14.

FIG. 14 shows that the tension (curve D) applied on the mask of a mask-frame assembly which was provided with bars or flat bars for a compensating unit according to the present invention is larger than the tension (curve C) applied on the mask of a conventional mask-frame assembly which had metallic members on the bottoms of resilient support members.

In this experiment, a bar having a thermal expansion coefficient of 9.61E−06 at 450° C. was used as a resilient support member. The thickness of a flat bar forming a compensating unit was 3 mm. Here, as shown in Tables 1 through 4, the values of a difference in thermal expansion between the resilient support member and the flat bar, the values of a second order section modulus I of the resilient support member in the X direction, the values of the height H of the flat bar from the center of each of first and second resilient support members, and the values of the width W of the flat bar were combined one by one and substituted for $(A \times H^2 \times \Delta\alpha \times 10^4)/I$, thereby obtaining parameters shown in Tables 1 through 4.

TABLE 1

| Width of compensating unit (mm) | Reduction rate of strip tension after heat treatment (%) | Parameter |
|---|---|---|
| 0 | −47.0 | 0.00 |
| 10 | −18.1 | 0.20 |
| 20 | −8.1 | 0.41 |
| 30 | −3.0 | 0.61 |
| 35 | −1.3 | 0.72 |

TABLE 2

| Installation height of compensating unit (mm) | Reduction rate of strip tension after heat treatment (%) | Parameter |
|---|---|---|
| 20 | −43.3 | 0.05 |
| 30 | −36.2 | 0.11 |
| 40 | −26.4 | 0.20 |
| 45 | −21.5 | 0.25 |
| 50 | −16.8 | 0.31 |
| 60 | −8.9 | 0.45 |
| 70 | −3.0 | 0.61 |

TABLE 3

| Thermal expansion coefficient of compensating unit | Reduction rate of strip tension after heat treatment (%) | Parameter |
|---|---|---|
| 1.22E-05 | −4.70 | 0.00 |
| 1.16E-05 | −36.3 | 0.15 |
| 1.08E-05 | −23.2 | 0.33 |
| 9.61E-06 | −3.0 | 0.61 |

TABLE 4

| Second order section modulus of compensating unit (lx) | Reduction rate of strip tension after heat treatment (%) | Parameter |
|---|---|---|
| 18574 | −3.0 | 0.61 |
| 27861 | −8.1 | 0.41 |
| 37148 | −12.1 | 0.31 |
| 55722 | −18.1 | 0.20 |

Figure 15:
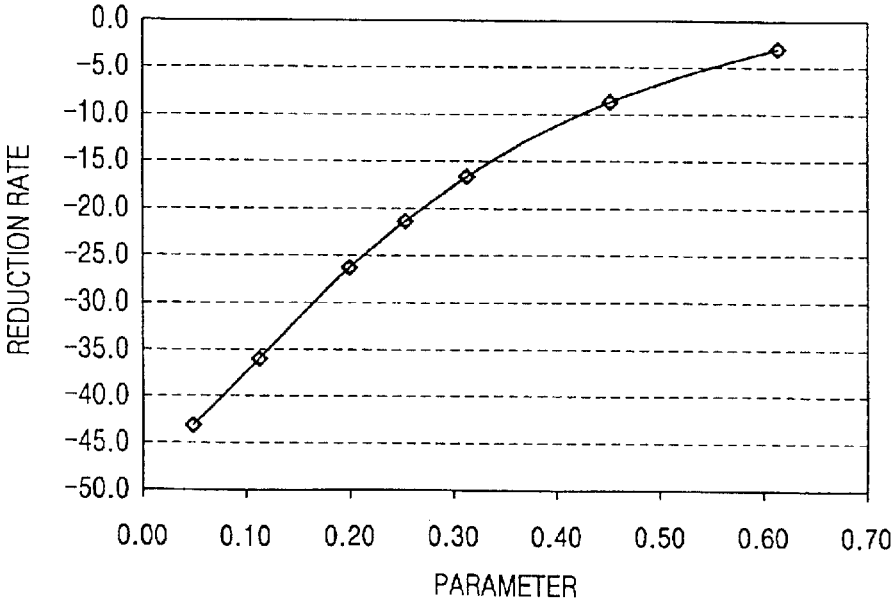
FIG. 15 is a graph of parameters versus reductions in mask tension.

The graph of FIG. 15 is obtained from the relation between tension and parameters according to the formula $(A \times H^2 \times \Delta\alpha \times 10^4)/I$ which are shown in Tables 1 through 4. As shown in FIG. 15, when the parameter according to the formula is greater than 0.1, tension is reduced by less than 35% after heat treatment. Accordingly, the thermal expansion coefficients of the resilient support member and the flat bar forming the compensating unit, and the installation height of the flat bar should be determined within a range satisfying $0.1 \leqq (A \times H^2 \times \Delta\alpha \times 10^4)/I$.

Figure 16:
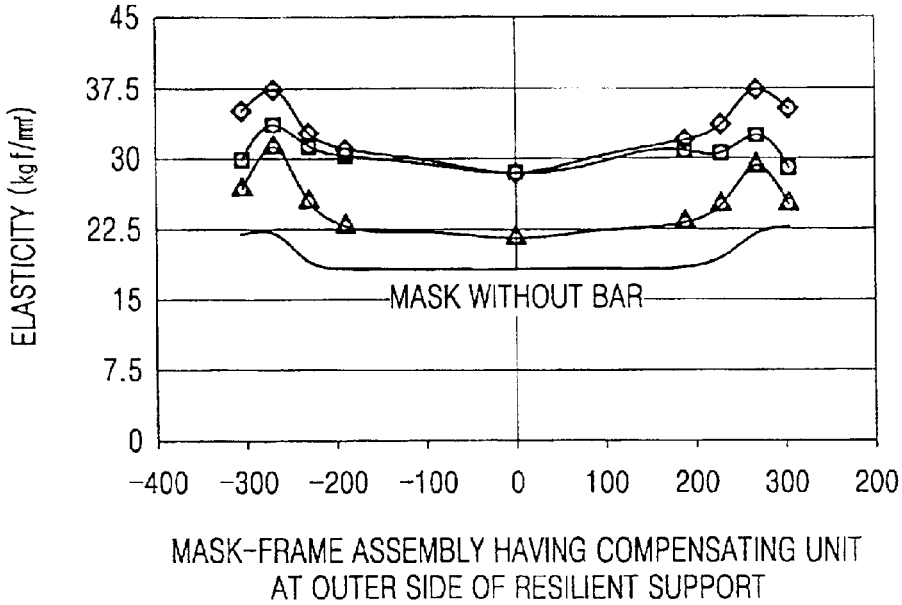
FIGS. 16 through 18 are graphs of reductions in tension according to positions of a compensating unit after heat treatment is performed on a mask-frame assembly.
Figure 17:
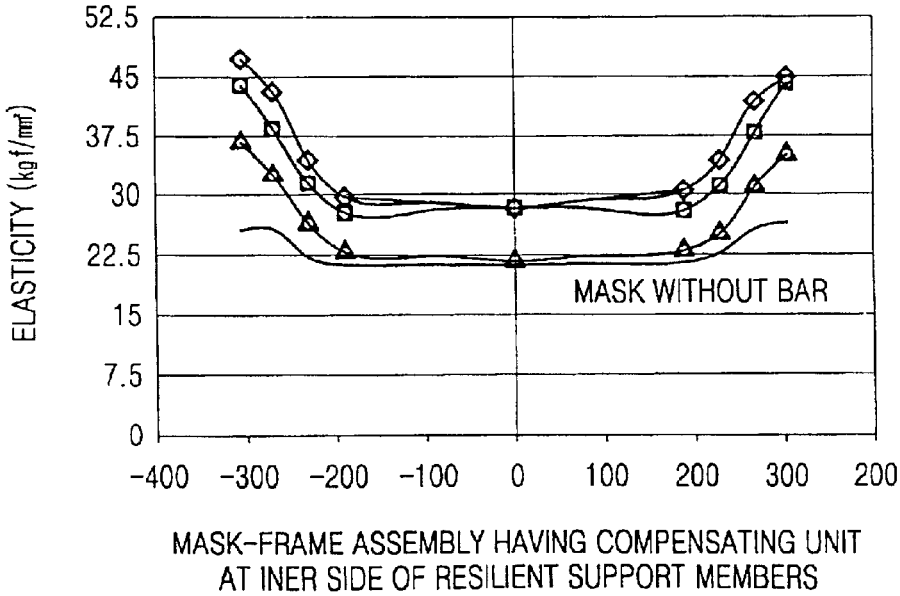
Figure 18:
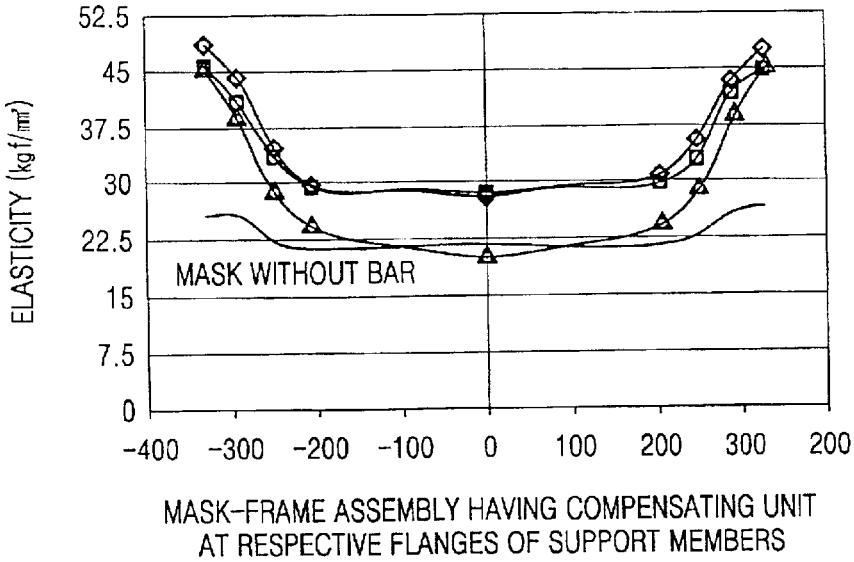

In this experiment, tension applied on a mask according to positions of a compensating unit in a mask-frame assembly subjected to heat treatment was compared with tension applied on a mask of a mask-frame assembly not having bars or flat bars forming a compensating unit after heat treatment, thereby obtaining the graphs of FIGS. 16 through 18. These graphs show that a reduction in tension on the mask of a mask-frame assembly according to the present invention is markedly decreased wherever the compensating unit is installed between the connecting portion of a resilient support member and the bottom of the mask.

As described above, a mask-frame assembly according to the present invention has the following effects.

First, a compensating unit is installed at both ends of a resilient support member between the top of the connecting portion of the resilient support member and the bottom of a mask or at support members, thereby radically preventing the plastic deformation of the mask which is caused by the thermal expansion of the resilient support member working on the mask as tension.

Second, since the compensating unit connects the respective ends of the support members, irregularly reflected electron beams and terrestrial magnetism can be shielded.

Third, the compensating unit supports two opposite edges of the mask, thereby facilitating manipulation of the mask-frame assembly.

Fourth, since a reduction in tension on the mask can be prevented, the amplitude of vibration of the mask due to an external impact is reduced, thereby decreasing howling of the mask.

Fifth, since a vibration preventing member is installed at each of first and second flat bars or bars, the vibration of the first and second bars or the bars caused by an external impact can be reduced. Furthermore, the vibration of the mask can be reduced.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A mask-frame assembly for a color cathode-ray tube, comprising:

first and second support members spaced out a predetermined distance;

first and second resilient support members installed between the first and second support members supporting the first and second support members, each of the first and second resilient support members comprising supports fixed to the first and second support members and a connecting portion connecting the supports;

a mask installed at the first and second support members such that tension is applied thereto, the mask comprising a plurality of electron beam through holes; and a compensating unit connected between the first and second support members or the supports of the resilient support members between each connecting portion and the mask, the compensating unit being formed of a material having a lower thermal expansion coefficient than that of the first and second resilient support members.

2. The mask-frame assembly of claim 1, wherein the compensating unit comprises a pair of bars each having both ends fixed to respective ends of the first and second support members.

3. The mask-frame assembly of claim 1, wherein the compensating unit comprises a pair of support bars each having both ends screwed to the respective ends of the first and second support members.

4. The mask-frame assembly of claim 1, wherein each of the first and second support members comprises a keeper supporting the mask and a flange extending inward from the edge of the keeper, and the compensating unit comprises a pair of bars each having both ends fixed to respective ones of the keepers of the first and second support members.

5. The mask-frame assembly of claim 1, wherein a thermal expansion coefficient of the mask is greater than that of the compensating unit and is equal to or greater than that of the first and second resilient support members.

6. The mask-frame assembly of claim 1, wherein the mask comprises:

a plurality of strips spaced out a predetermined distance, wherein the plurality of electron beam through holes are formed between the strips at predetermined pitches;

real bridges for connecting the strips to one another, to separate the electron beam through holes which are formed in a same line; and a plurality of dummy bridges extending from the strips to partition the electron beam through holes.

7. The mask-frame assembly of claim 1, wherein the compensating unit comprises a pair of flat bars each having both ends fixed to the supports of the respective first and second resilient support members.

8. The mask-frame assembly of claim 7, wherein the compensating unit comprises a vibration reduction unit installed at each of the flat bars to reduce vibration thereof.

9. The mask-frame assembly of claim 7, wherein the bars are fixed to surfaces of the supports of the first and second resilient support members which face the supports of the other one of the first and second resilient support members.

10. The mask-frame assembly of claim 7, wherein the bars are fixed to surfaces of the supports of the first and second resilient support members which face away from the supports of the other one of the first and second resilient support members.

11. The mask-frame assembly of claim 1, wherein each of the first and second support members comprises a keeper supporting the mask and a flange extending inward from the edge of the keeper, and the compensating unit comprises a pair of bars each having both ends fixed to respective ones of the flanges of the first and second support members.

12. The mask-frame assembly of claim 11, wherein the bars are formed on surfaces of the flanges facing away from the mask.

13. The mask-frame assembly of claim 11, wherein the bars are formed on surfaces of the flanges facing the mask.

14. The mask-frame assembly of claim 11, wherein the compensating unit comprises:

a first and second pair of first and second brackets extending from respective ends of the first and second support members in facing directions; and a pair of bars each having both ends fixed to the respective pair of first and second brackets.

15. The mask-frame assembly of claim 15, further comprising coupling units fixing the bars to the respective pair of first and second brackets.

16. The mask-frame assembly of claim 15, wherein each coupling unit is one among a bolt and nut, a rivet, and screws formed at both ends of the respective bar and the respective pair of first and second brackets.

17. The mask-frame assembly of claim 16, wherein each coupling unit comprises screws formed at both ends of the respective bar and the respective pair of first and second brackets, and the screws formed at both ends of each respective bar spirals in an opposite direction.

18. The mask-frame assembly of claim 1, wherein the compensating unit comprises:

a pair of bars connected between the first and second support members or the supports of the first and second resilient members; and a vibration reduction unit attached to each bar to reduce a vibration thereof.

19. The mask-frame assembly of claim 18, wherein the vibration reduction unit comprises:

at least one via-hole formed in each bar and a corresponding vibration preventing member movably installed in the via-hole.

20. The mask-frame assembly of claim 19, wherein each vibration preventing member comprises:

a body which has a smaller diameter than the corresponding via-hole; and heads respectively formed at each end of each body, to prevent the corresponding body from coming out of the corresponding via-hole.

21. A mask-frame assembly for a color cathode-ray tube, comprising:

a frame comprising first and second support members spaced out a predetermined distance, and first and second resilient support members installed between the first and second support members, supporting the first and second support members, each of the first and second resilient support members comprising supports fixed to the first and second supports and a connecting portion connecting the supports;

a mask installed at the first and second support members such that tension is applied thereto, the mask comprising a plurality of electron beam passage holes; and a compensating unit connected between the first and second support members or the supports of the first and second resilient members between each connecting portion and the mask, the compensating unit being formed of a material having a lower thermal expansion coefficient than that of the first and second resilient support members, wherein values of a length L of the frame, a sectional area A of the compensating unit, a difference-$\Delta\alpha$ in thermal expansion between each resilient support member and the compensating unit, a height H from a center of a height of each of the first and second resilient support members to the compensating unit, and a second order section modulus I in an X direction when first and second directions perpendicular to each other of the section of each resilient support member are represented by X and Z, respectively, are set to satisfy $0.1 \leqq (A \times H^2 33\ 66\ \alpha \times 10^4)/I \leqq$.

22. The mask-frame assembly of claim 21, wherein the values are set to satisfy $0.1 \leqq (A \times H^2 \Delta\alpha \times 10^4)/I \leqq$.

23. The mask-frame assembly of claim 21, wherein the compensating unit comprises a pair of bars each having both ends fixed to respective ends of the first and second support members.

24. The mask-frame assembly of claim 21, wherein the compensating unit comprises;

a first and second pair of first and second brackets extending from respective ends of the first and second support members in facing directions; and a pair of bars each having both ends fixed to the respective pair of first and second brackets.

25. The mask-frame assembly of claim 21, wherein a thermal expansion coefficient of the mask is greater than that of the compensating unit and is equal to or greater than that of the first and second resilient support members.

26. The mask-frame assembly of claim 21, wherein the mask comprises:

a plurality of strips spaced out a predetermined distance, wherein the plurality of electron beam through holes are formed between the strips at predetermined pitches;

real bridges for connecting the strips to one another, to separate the electron beam through holes which are formed in a same line; and a plurality of dummy bridges extending from the strips to partition the electron beam through holes.

27. The mask-frame assembly of claim 21, wherein the compensating unit comprises a pair of flat bars each having both ends fixed to the supports of the respective first and second resilient support members.

28. The mask-frame assembly of claim 27, wherein the bars are fixed to surfaces of the supports of the first and second resilient support members which face the supports of the other one of the first and second resilient support members.

29. The mask-frame assembly of claim 27, wherein the bars are fixed to surfaces of the supports of the first and second resilient support members which face away from the supports of the other one of the first and second resilient support members.

30. The mask-frame assembly of claim 27, wherein the compensating unit comprises a vibration reduction unit installed at each of the flat bars to reduce vibration thereof.

31. The mask-frame assembly of claim 30, wherein the vibration reduction unit comprises at least one via-hole formed at each flat bar and a corresponding vibration preventing member shakably installed in the via-hole.

32. The mask-frame assembly of claim 21, wherein each of the first and second support members comprises a keeper supporting the mask and a flange extending inward from the edge of the keeper, and the compensating unit comprises a pair of bars each having both ends fixed to respective ones of the flanges of the first and second support members.

33. The mask-frame assembly of claim 32, wherein the bars are formed on surfaces of the flanges facing away from the mask.

34. The mask-frame assembly of claim 32, wherein the bars are formed on surfaces of the flanges facing the mask.

35. A mask-frame assembly for a color cathode-ray tube, comprising:

a frame comprising first and second support members spaced out a predetermined distance, and first and second resilient support members installed between the first and second support members, supporting the first and second support members, each of the first and second resilient support members comprising supports fixed to the first and second supports and a connecting portion connecting the supports;

a mask installed at the first and second support members such that tension is applied thereto, the mask comprising a plurality of electron beam passage holes; and a compensating unit connected between the first and second support members or the supports of the first and second resilient members between each connecting portion and the mask so that the tension of the mask is transferred to the compensating unit during annealing of the frame and the mask and then the tension is re-transferred from the compensating unit to the mask after cooling, thereby maintaining an initial tension of the mask.

36. The mask-frame assembly of claim 35, wherein the compensating unit comprises a vibration reduction unit to reduce vibration thereof.

37. The mask-frame assembly of claim 35, wherein a thermal expansion coefficient of the mask is greater than that of the compensating unit and is equal to or greater than that of the first and second resilient support members.

38. The mask-frame assembly of claim 35, wherein the mask comprises:

a plurality of strips spaced out a predetermined distance, wherein the plurality of electron beam through holes formed between the strips at predetermined pitches;

real bridges for connecting the strips to one another, to separate the electron beam through holes which are formed in a same line; and a plurality of dummy bridges extending from the strips to partition the electron beam through holes.

39. A mask-frame assembly for a color cathode-ray tube, comprising:

a frame comprising first and second support members spaced out a predetermined distance, and first and second resilient support members installed between the first and second support members, supporting the first and second support members, each of the first and second resilient support members comprising supports fixed to the first and second supports and a connecting portion connecting the supports;

a mask installed at the first and second support members such that tension is applied thereto, the mask comprising a plurality of electron beam passage holes; and a compensating unit in which the tension of the mask is transferred to the compensating unit during annealing of the frame and the mask and then the tension is re-transferred from the compensating unit to the mask after cooling, thereby maintaining an initial tension of the mask.

40. The mask frame assembly of claim 39, wherein the compensating unit maintains the tension during an annealing process of the mask.

* * * * *

UNITED STATES PATENT AND TRADEMARK OFFICE

CERTIFICATE OF CORRECTION

PATENT NO. : 6,900,584 B2
DATED : May 31, 2005
INVENTOR(S) : Joon-Soo Bae et al.

It is certified that error appears in the above-identified patent and that said Letters Patent is hereby corrected as shown below:

Column 11,
Line 49, change "claim 15" to -- claim 14 --.

Column 12,
Line 43, change "$0.1 \leq (AxH^2 33\ 66\ \alpha x104)/I \leq$" to -- $0.1 \leq (AxH^2 x \Delta\alpha x10^4)/I$ --.
Line 45, change "$0.1 \leq (AxH^2 \Delta\alpha x10^4)/I \leq$" to -- $0.1 \leq (AxH^2 x \Delta\alpha x10^4)/I < 1$ --.

Signed and Sealed this

Thirteenth Day of September, 2005

JON W. DUDAS
*Director of the United States Patent and Trademark Office*